US005918750A

United States Patent [19]

Jackson

[11] Patent Number: 5,918,750

[45] Date of Patent: Jul. 6, 1999

[54] FIXTURE FOR DISPLAYING MERCHANDISE

[75] Inventor: Donald A. Jackson, Coral Springs, Fla.

[73] Assignee: The Sports Authority Michigan, Inc., Royal Oak, Mich.

[21] Appl. No.: 08/957,344

[22] Filed: Oct. 24, 1997

[51] Int. Cl.[6] ..... A47F 5/00

[52] U.S. Cl. ..... 211/189; 108/108; 211/181.1; 211/190; 211/194

[58] Field of Search ..... 211/186, 181.1, 211/187, 190, 189, 194, 208; 280/79.3; 108/108

[56] References Cited

U.S. PATENT DOCUMENTS

| | | | |
|---|---|---|---|
| 2,965,242 | 12/1960 | Grotke | 211/148 |
| 2,991,889 | 7/1961 | Levy et al. | 211/177 |
| 3,160,281 | 12/1964 | Ruhnke | 211/177 |
| 3,502,292 | 3/1970 | Yoder | 211/189 X |
| 3,750,893 | 8/1973 | Kempler | 211/162 |
| 3,971,477 | 7/1976 | Bruderly et al. | 211/189 |
| 4,046,083 | 9/1977 | Murdoch et al. | 211/190 X |
| 4,068,855 | 1/1978 | Hackett | 280/79.3 |
| 4,127,196 | 11/1978 | Boucher | 211/207 |
| 4,199,069 | 4/1980 | Talarico | 211/194 |
| 4,693,383 | 9/1987 | Fenwick | 211/192 |
| 4,744,475 | 5/1988 | St. Pierre | 211/134 |
| 4,829,977 | 5/1989 | Valentine | 211/186 X |
| 4,919,282 | 4/1990 | Duff et al. | 211/134 |
| 5,127,341 | 7/1992 | Wiklund | 108/111 |
| 5,255,803 | 10/1993 | Pavone et al. | 211/189 |
| 5,372,262 | 12/1994 | Benson et al. | 211/26 |
| 5,407,262 | 4/1995 | Christian et al. | 211/189 X |
| 5,529,192 | 6/1996 | Conen et al. | 211/189 |
| 5,566,844 | 10/1996 | Bernardin | 211/189 |
| 5,573,124 | 11/1996 | Frost | 211/181 |
| 5,605,238 | 2/1997 | Jacobs | 211/90 |
| 5,607,070 | 3/1997 | Hellyer | 211/189 |
| 5,722,544 | 3/1998 | Williams | 211/186 X |

*Primary Examiner*—Robert W. Gibson, Jr.
*Attorney, Agent, or Firm*—Holland & Knight LLP

[57] ABSTRACT

A fixture for displaying merchandise comprises a base member, vertical posts, and, in one embodiment, horizontal beams extending between the posts. Depending upon the particular application for which the fixture is intended, the vertical supports are affixed to the base member to form a gondola unit, an H-frame unit or a combination gondola and H-frame unit, as desired. The base member is provided with rollers to permit movement of the fixture when either unloaded or loaded with merchandise, and the vertical supports are connectable to extensions to vary the overall height of the fixture.

31 Claims, 5 Drawing Sheets

38
40
16
18'
46'
48'
46
48
50
52
54
56
58
59
60
66
68

FIXTURE FOR DISPLAYING MERCHANDISE

FIELD OF THE INVENTION

This invention relates to fixtures, and, more particularly, to a fixture for displaying merchandise which is mobile, adjustable in height and convertible from a gondola configuration to an H-frame unit.

BACKGROUND OF THE INVENTION

A variety of fixtures or units for displaying merchandise have been employed in retail outlets. Two of the most widely used fixtures are "gondola" units and "H-frame" units. Such units have different appearances, and are often employed for displaying different types of merchandise, but both are commonly used in the same retail establishment.

Gondola fixtures generally comprise a base, typically square or rectangular in shape, which mounts a pair of opposed vertical supports extending upwardly from the center portion thereof at each end. In most instances, a sheet of peg board is retained by the opposed vertical supports in an upright position, with one edge of the peg board supported on the base, so that the base is essentially divided in half on opposite sides of the peg board. Hooks or brackets are received within the holes of the peg board to mount merchandise to the display.

Gondola units of the type described above have a number of disadvantages which limit their effectiveness and versatility. In most instances, the base of gondola units is provided with levelers engageable with the floor to orient the unit in a horizontal position, but no rollers or other means are included on the base to permit movement of the overall unit either before or after it is loaded with merchandise. Consequently, in order to relocate a gondola unit from one location to another, the levelers must be retracted, the unit unloaded and in many cases disassembled, and, then reassembled at the new location. Additionally, most gondola units are not vertically adjustable, i.e., the vertical supports mounted to the base are provided in one standard height, and no extensions are provided to increase the overall height of the unit as desired. Further, the peg board employed to mount hooks or brackets which support merchandise is often visually unattractive and has a limited useful life. Typically, the holes in the peg board are either torn or expanded in size by repeated insertion and removal of the hooks, requiring that the peg board be replaced after a limited period of time.

H-frame units suffer from many of the same disadvantages as gondola units, often to an even greater extent. In most designs, H-frame units comprise a base which is generally rectangular in shape having four vertical posts each extending upwardly from one of the corners of the base. In many instances, the vertical posts and/or base are bolted to the floor to increase stability. A horizontally extending arm or beam is mounted between the comer posts on the opposite side, with an opposed horizontal beam mounted to the opposite set of comer posts, to provide a support for a horizontally extending shelf whose overall area is approximately equal to that of the base. One or more shelves are mounted along the vertical posts in this fashion to support merchandise.

In order to provide sufficient rigidity to H-frame units, cross braces are typically welded between the comer posts at each end of the base at spaced intervals along their vertical length. The horizontal beams and shelves are clipped to the comer posts to provide further rigidity to the overall structure. As a result of this construction, H-frame units present a number of difficulties in assembly, and, are of limited versatility once in place in a retail establishment or other outlet. The corner posts and welded cross braces are extremely heavy and bulky, as are the horizontal shelves. Consequently, most retail establishments employ professional fixture assemblers to install H-frame units at their premises. When it is desired to move the H-frame units to a different location within the store, or replace them with another type of display, the fixture assemblers must be called in to disassemble and then reassemble such units. Moreover, all of the merchandise on the display must be removed, and then replaced on the unit after it has been relocated. Additionally, in most designs, the vertical posts are of one dimension, e.g., eight feet or twelve feet in height.

In addition to the individual limitations and inefficiencies of the gondola units and H-frame fixtures described above, it is noted that such units historically employ different parts or components which are not interchangeable with one another. That is, the base and vertical posts of one gondola unit are not interchangeable with the base and corner posts, and/or horizontal beams, employed in H-frame units. As a result, retailers have been required to purchase and stock separate components of each type of unit in the event it is desired to employ both gondolas and H-frames in the same establishment. This disadvantage, and the costs associated with assembly, disassembly, stocking and restocking of both types of units, substantially adds to the overhead expenses of retailers in terms of both high labor costs and storage charges.

SUMMARY OF THE INVENTION

It is therefore among the objectives of this invention to provide a fixture for displaying merchandise which is movable within a retail establishment either when loaded or unloaded with merchandise, which is constructed from a relatively limited number of parts, which can be readily varied in height depending upon the requirements of a particular display application, and, which can be converted from a gondola style unit to an H-frame unit using many of the same parts.

These objectives are accomplished in a fixture for displaying merchandise which comprises a base member, vertical posts, and, in one embodiment, horizontal beams extending between the posts. Depending upon the particular application for which the fixture is intended, the vertical supports are affixed to the base member to form either a gondola unit or an H-frame unit, as desired. The base member is provided with rollers to permit movement of the fixture when either unloaded or loaded with merchandise, and the vertical supports are connectable to extensions to vary the overall height of the fixture.

In the presently preferred embodiment a "universal" base member is provided having opposed end walls and opposed side walls which are interconnected to form four comers and an interior. Rollers are mounted at each comer of the base to permit movement thereof, and, hence, the entire fixture whether it is loaded or unloaded. Levelers are extended from the base to the floor of an establishment, when it is placed in a position for displaying merchandise, to level the display and prevent it from moving on the rollers.

In one presently preferred embodiment, the base member is provided with post supports or comer sleeves at each comer, and one center sleeve midway along each of the end walls. These sleeves each receive one end of a vertical post, and a locking device releasably mounts the vertical posts therein. One vertical post can be mounted atop another vertical post, employing a locking device similar to that used to mount the posts to the base member, to vary the overall height of the units, as desired.

In order to form one embodiment of the gondola unit of this invention, a vertical post is mounted in each of the center sleeves located midway along the end walls of the base member, while the sleeves at the comers of the base member receive no posts. A number of base members can be connected end-to-end to one another, using connector plates insertable within the sleeves at the comers of the base member, in order to form an aisle along the floor of a retail establishment. One or more wire grids are positioned between the vertical supports of the gondola unit which mount hooks or brackets to support merchandise thereon. In one presently preferred embodiment, a sheet of material containing art work or the like is sandwiched between opposed wire grids held by the vertical posts of the gondola unit to enhance the overall visual appearance of the display.

Alternatively, the vertical posts can be mounted to the same base member to form an H-frame unit instead of a gondola unit. In an H-frame unit configuration, the vertical posts are mounted to the sleeves at each comer of the base member with no posts midway along the end walls. One or more sets of horizontal beams extend between opposed comer posts, e.g., along each side wall of the base member, to provide supports for horizontally extending shelves. The shelves, in turn, carry the merchandise to be displayed.

In still another embodiment of this invention, one or more additional, internal sleeves are carried by each base unit in between the comer sleeves, e.g., to one side or the other of the center sleeves. This enables the base units to be employed to form a combination gondola unit and H-frame unit in which vertical posts are connected to the base unit at the corners and within a selected internal sleeve located between the comers. The same horizontal beams are mounted between the corner posts as in the H-frame unit noted above, but, in one embodiment, the horizontal shelves are not as deep and extend between the horizontal beams and the vertical posts located between the comers of the base unit. Alternatively, one or more shelves can be mounted directly to the vertical posts in a cantilever fashion as in conventional gondola units. Additionally, a vertically oriented wire grid can be positioned between adacent vertical supports mounted within opposed internal sleeves to create the look and functionality of a gondola unit in combination with the H-frame construction.

The fixtures of this invention have a number of advantages compared to the gondola and H-frame units currently in use. The same base member and vertical posts are employed in the gondola, H-frame units and combined units of this invention. The base member is supported on rollers, allowing the units to be moved to different locations without unloading merchandise therefrom. As noted above, the vertical posts employed in the units can be connected one on top of the other to vary the overall height of the gondola unit, H-frame display or the combined unit. Additionally, several base members of such units can be connected end-to-end to form aisles within a particular store or other outlet.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figures 2, 2A, 3, 3A, 4:
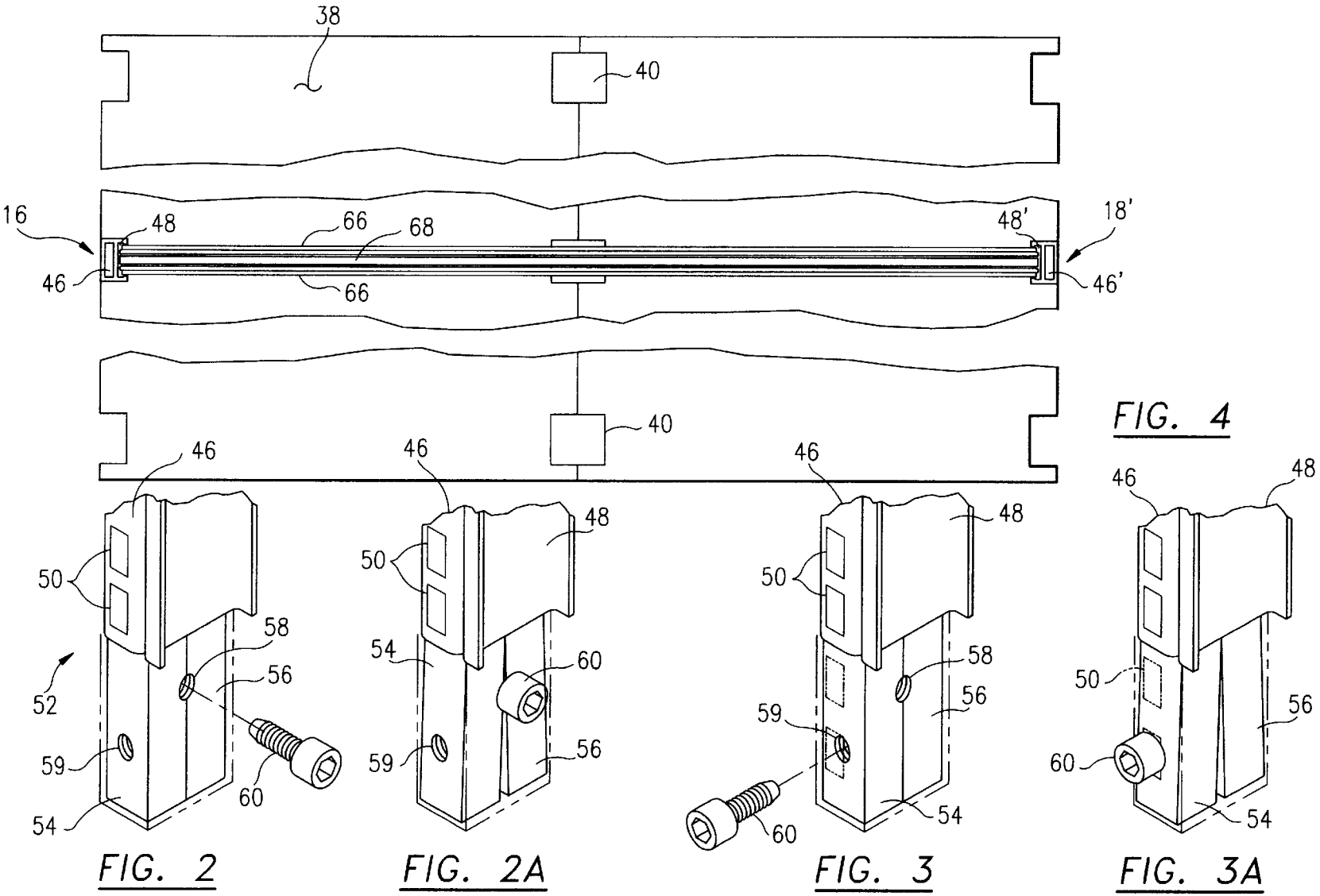
FIG. 2 is an enlarged, disassembled view of the locking device employed to mount vertical posts to the base member of the units herein.
FIG. 2A is a view similar to FIG. 2 except with the locking device assembled.
FIG. 3 is an enlarged, disassembled view of the locking device which mounts one vertical post atop another.
FIG. 3A is a view similar to FIG. 3 except with the locking device assembled.
FIG. 4 is a cut away, plan view of the gondola unit illustrating the wire grids and display sheet.
Figure 5:
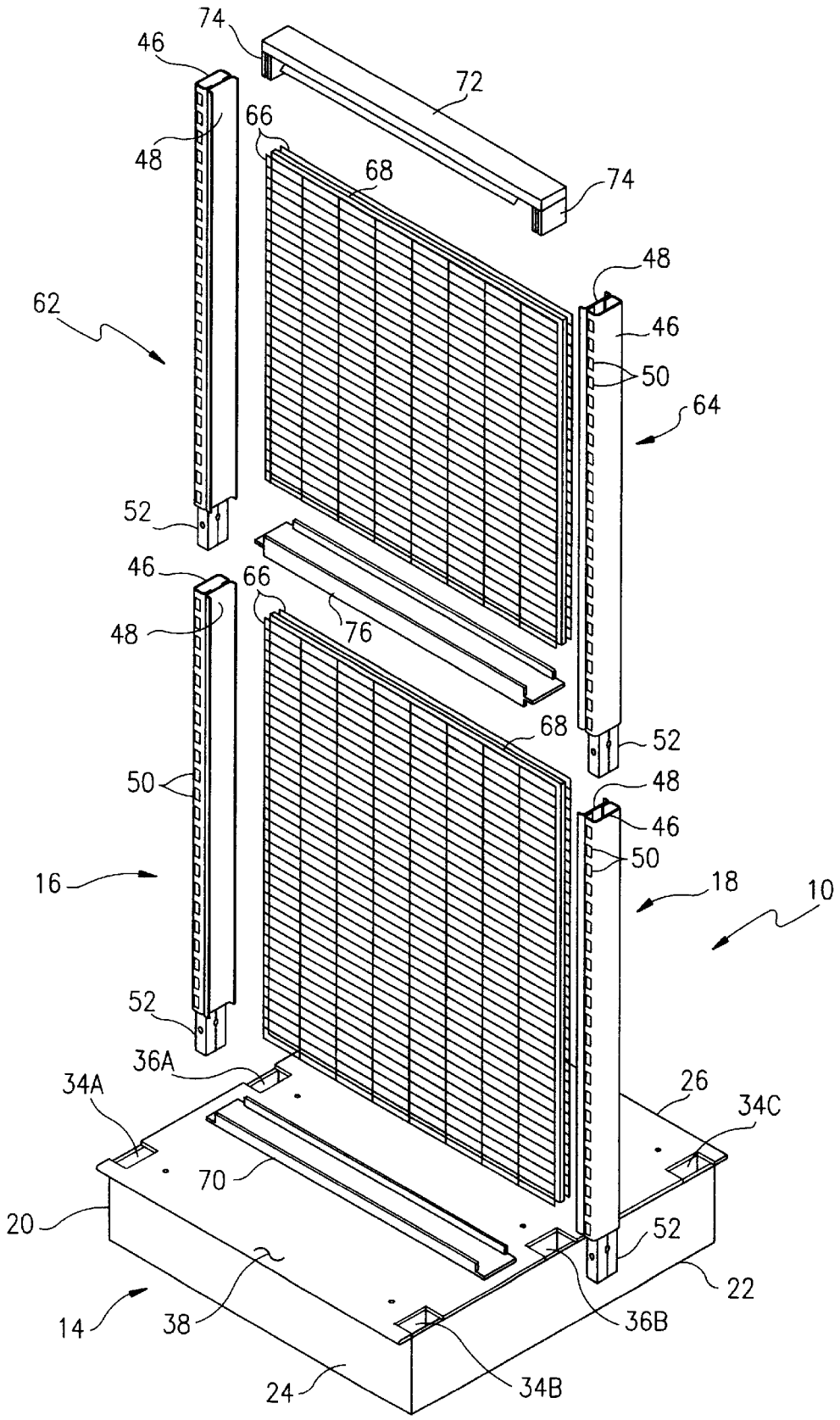
FIG. 5 is a partially exploded, perspective view of the gondola unit herein.
Figure 6:
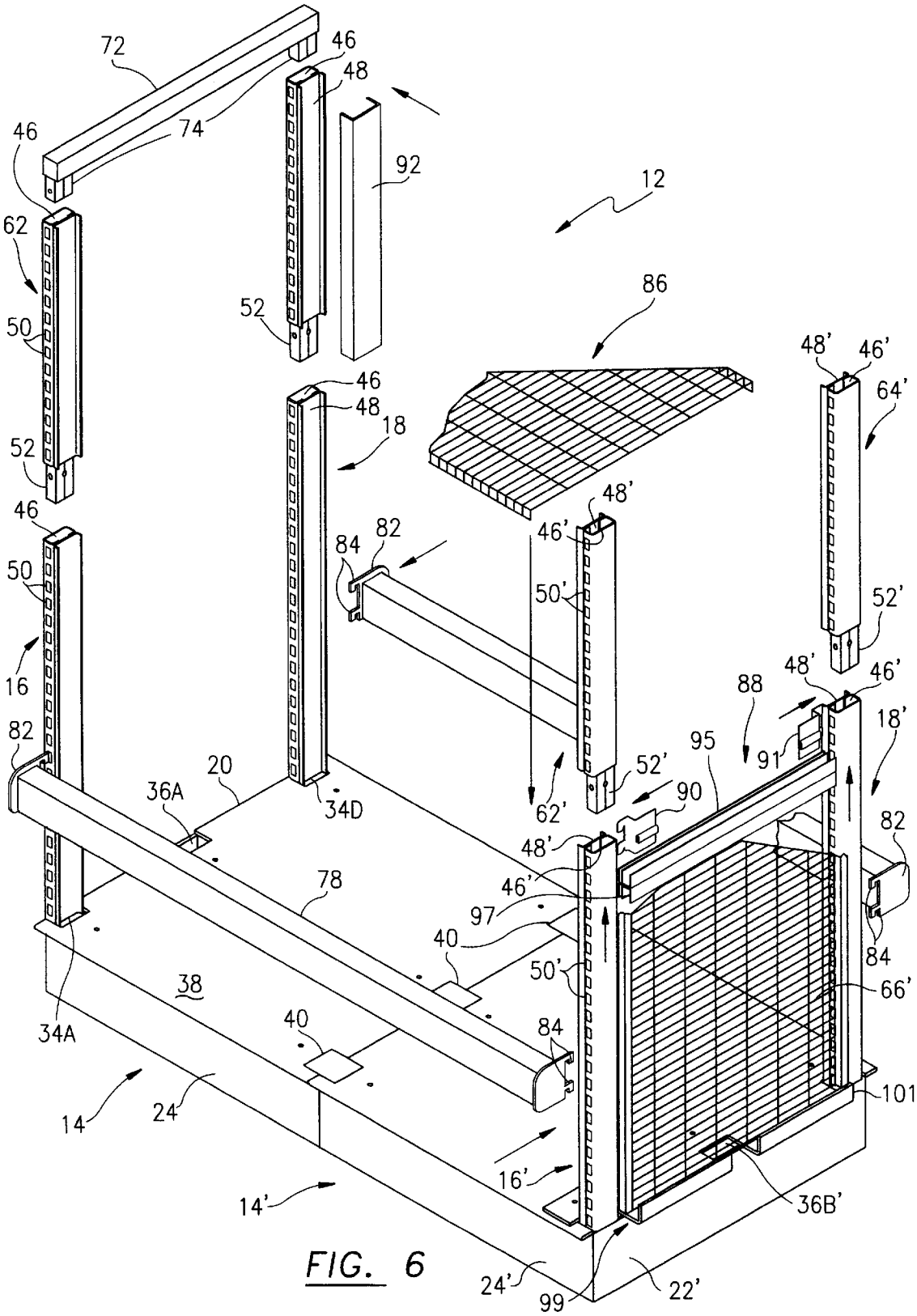
FIG. 6 is an exploded, perspective view of the H-frame unit of this invention.
Figure 7:
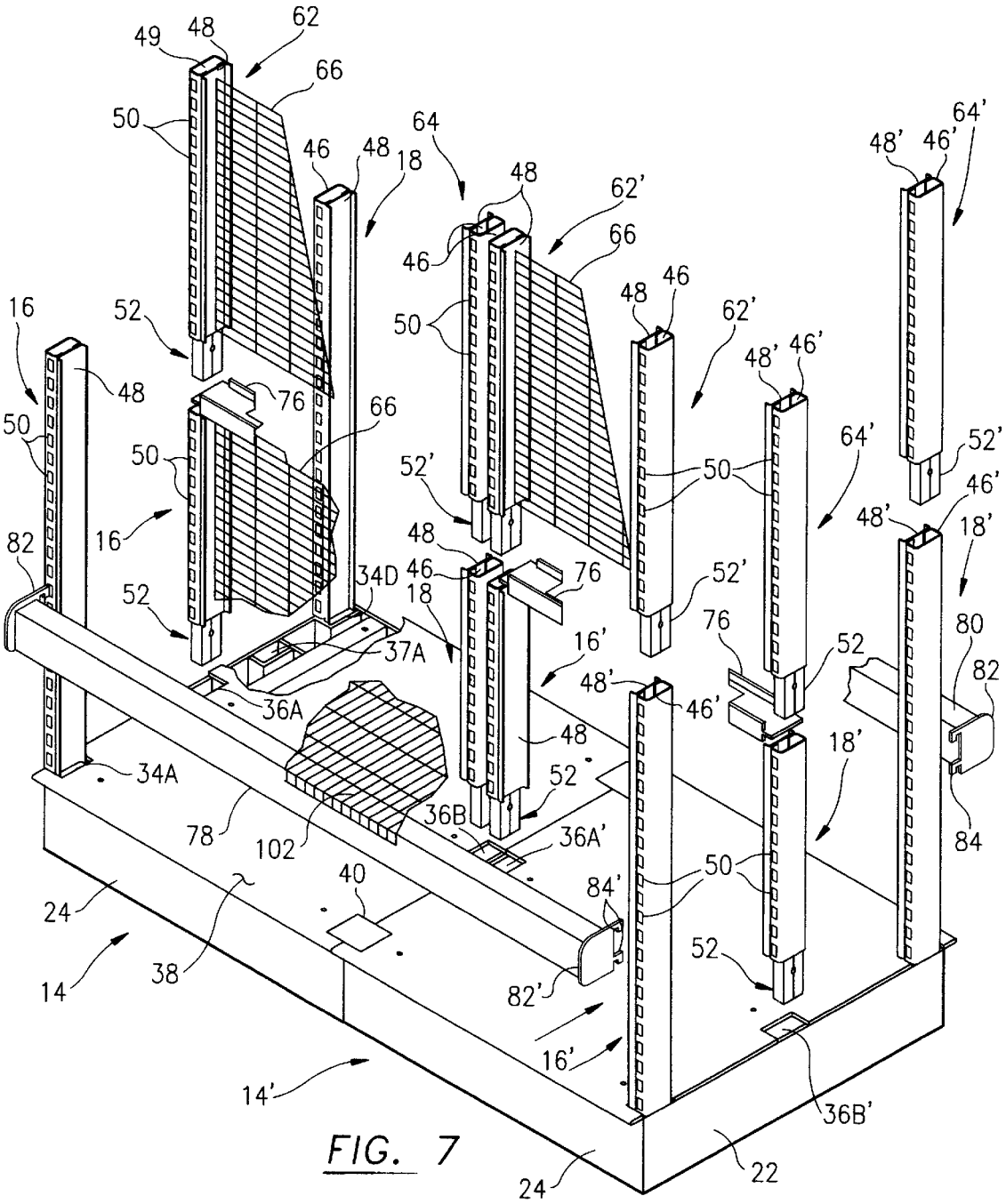
FIG. 7 is an exploded, perspective view of a combined gondola and H-frame unit.

With reference to FIGS. 1–7, the structural elements of the fixture of this invention are capable of being assembled to form a gondola unit 10 depicted in FIGS. 1–5, an H-frame unit 12 shown in FIG. 6, or a combined unit 100 illustrated in FIG. 7. For purposes of the present discussion, the gondola unit 10, H-frame unit 12 and combined unit 100 are discussed separately below with the same structural elements common to both units given the same reference numbers in the drawings.

Gondola Unit

Referring initially to FIGS. 1–5, the gondola unit 10 comprises at least one base member 14 and a pair of vertical posts 16 and 18' which are mounted to the base member 14 in a manner described in more detail below. In the embodiment depicted in FIG. 1, two base members 14 and 14' are shown which are positioned end-to-end to illustrate how the gondola units 10 can be interconnected to form, for example, an aisle within a store or other establishment. Each base member 14, 14' is identical in construction, and therefore only base member 14 is described in detail herein. The same reference numbers are used to identify the same structure in base member 14' with the addition of a "'".

The base member 14 includes opposed end walls 20, 22 and opposed side walls 24, 26 which are interconnected to form four comers and an interior. One cross brace 28 is mounted between the side walls 24, 26 adjacent and parallel to end wall 20, and a second cross brace 30 is mounted between the side walls 24, 26 parallel to and adjacent the end wall 22. Four swivel rollers 32, one of which is illustrated in FIG. 1, are mounted at the corners of the base member 14 to opposed ends of cross braces 28, 30 to permit the base member 14, and, hence, the gondola unit 10, to be movable along the floor.

Four post supports or hollow sleeves 34A–D are mounted at the four corners of the base member 14, as shown. The corner sleeve 34A, for example, is secured at the corner formed by end wall 20 and side wall 24, and is located between the cross brace 28 and end wall 20. Each of the other corner sleeves 34B–D are similarly mounted in their respective corners. Two centrally disposed post supports or center sleeves 36A and B, which are identical to sleeves 34A–D, are mounted to the base member 14 at a location approximately in the center of the end walls 20 and 22. Center sleeve 36A is thus positioned between corner sleeves 34A and D, and is mounted between the end wall 20 and cross brace 28. Similarly, center sleeve 36B is located between the corner sleeves 34B, C, and is mounted between the cross brace 30 and end wall 22.

In the presently preferred embodiment, two additional, internal sleeves 37A and 37B are mounted to the same structure of base unit as center sleeves 36A, B, and are positioned at a selected location between the corners of base unit 14. As depicted in FIG. 1, internal sleeve 37A is located between center sleeve 36A and corner sleeve 34D, whereas internal sleeve 37B is located between center sleeve 36B and corner sleeve 36C. The internal sleeves 37A, B are structurally and functionally the same as center sleeves 36A, B, and are particularly useful in the combined unit 100 described below in connection with a discussion of FIG. 7. It should be understood that the number and position of internal sleeves 37 can be varied such that a selected number of internal sleeves 37 can be located at essentially any desired position between the corners of each base member 14.

Figure 1:
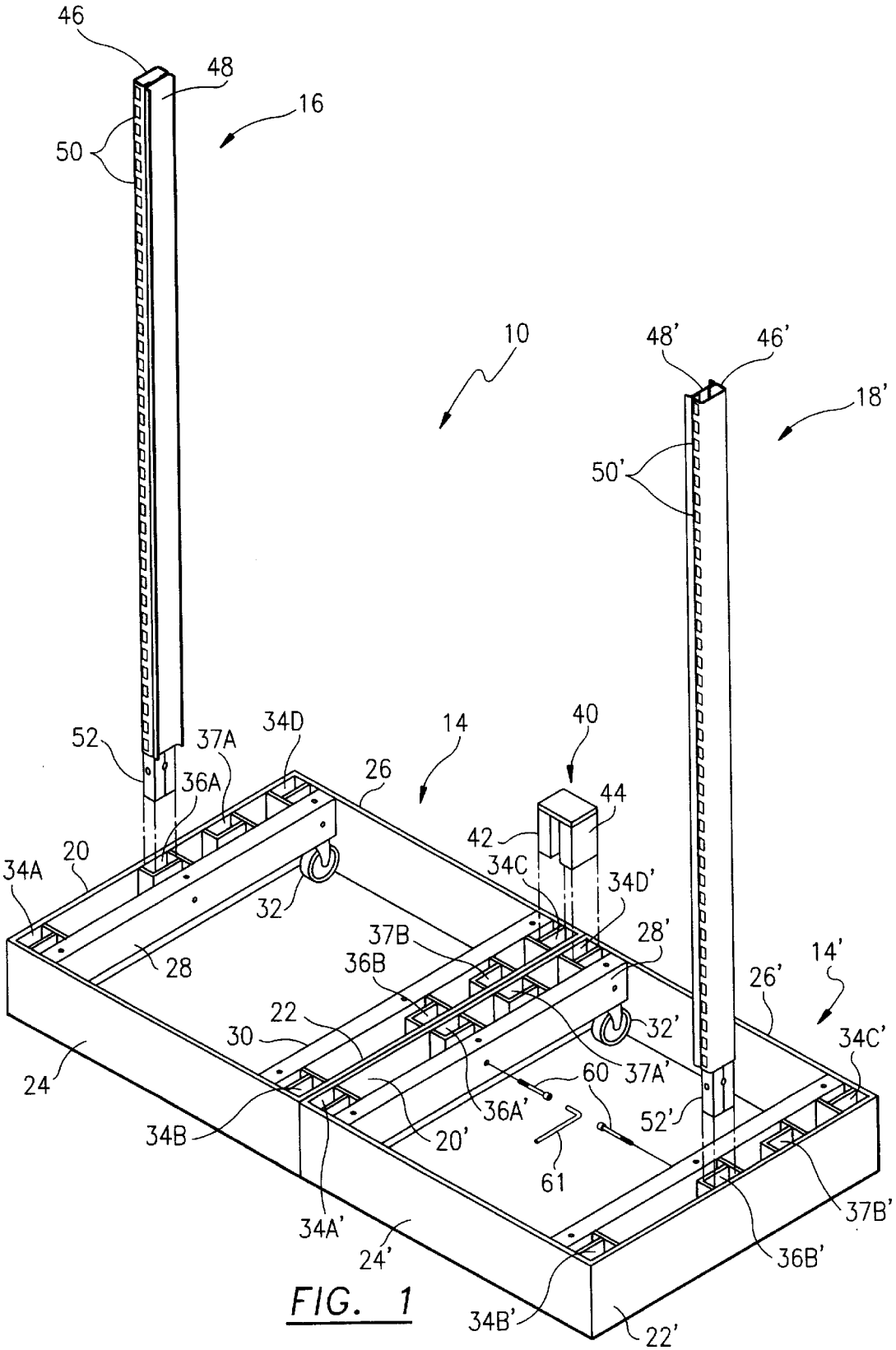
FIG. 1 is a partially disassembled, cut-away perspective view of the gondola unit of this invention.

As noted above, two base members 14 and 14' are shown in FIG. 1 to depict the manner in which multiple gondola units 10 can be oriented end-to-end to form a continuous display of essentially any length. When the base members 14 and 14' abut with one another, the end wall 22 of base member 14 contacts the end wall 20' of base member 14'. A base cover plate 38 is placed over the open interior of each base member 14 as depicted in FIG. 5. In order to interconnect one base member 14 with an adjacent base member 14', connector brackets 40 are employed having spaced legs 42 and 44. As shown in FIG. 1, the leg 42 of connector bracket 40 is inserted within the corner sleeve 34C of base member 14, while the leg 44 of connector bracket 40 extends into the corner sleeve 34D' of base member 14'. A second connector bracket 40 is inserted into the abutting corner sleeves 34B and 34A' of base members 14, 14', respectively, to completely secure the two base members 14, 14' together. See FIG. 4.

As noted above, and as best seen in FIGS. 4 and 5, the gondola unit 10 includes a pair of vertical posts 16, 18 which are mounted to base member 14. Each vertical post 16 and 18 has a cross section including a tubular shaped portion 46 and a U-shaped channel section 48 extending along the entire vertical extent of the post. Vertically spaced slots 50 are formed in each vertical post 16, 18 along the tubular shaped portion 46 thereof. In the presently preferred embodiment, the top end of each vertical post 16, 18 is hollow, whereas the bottom end thereof receives an extension 52 which is mounted thereto and extends outwardly from the bottom of the post 16, 18. For purposes of the present discussion, the term "top" is intended to refer to the orientation of the vertical posts 16, 18 as depicted in the Figs., and the term "bottom" refers to the opposite direction.

The extension 52 is comprised of side by side channel members 54 and 56 which have a combined cross-sectional area slightly less than the cross-sectional area of the corner sleeves 34A–D and center sleeves 36A and B. A first threaded bore 58 is formed at the juncture of channel members 54, 56 which receives a bolt 60 and a second threaded bore 59 is formed in channel member 54 at a right angle to bore 58. See FIGS. 2–3A. In order to mount the vertical post 18 to base member 14, the extension 52 of vertical post 18 is inserted with the center sleeve 36B of base member 14. The bolt 60 is then tightened into the threaded bore 58, as by an Allen wrench 61 schematically shown in FIG. 1, so that the channel members 54, 56 of extension 52 are spread apart from one another against the side walls of the center sleeve 36B. This securely locks the extension 52 within the center sleeve 36B and firmly mounts the vertical post 18 in an upright position to the base member 14. The same procedure is repeated for mounting vertical post 16 to the center sleeve 36A so that the gondola unit 10 has opposed vertical posts 16, 18 at the center of base member 14 mounted within the center sleeves 36A, B. See FIG. 5.

In the presently preferred embodiment, each vertical post 16 and 18 is of a predetermined height, not including the height of extensions 52. In order to increase the overall height of gondola unit 10, additional vertical posts 62 and 64 can be secured to the top ends of vertical posts 16, 18, respectively. The vertical posts 62, 64 have the same extension 52 as vertical posts 16, 18 described hereinabove, and may or may not be of the same vertical height. As shown in FIG. 5, the extension 52 of vertical post 62 is insertable into the tubular shaped portion 46 of vertical post 16, and the extension 52 of vertical post 64 is insertable within the tubular shaped portion 46 of the vertical post 18. These extensions 52 are secured within the top portion of vertical posts 16, 18 with bolts 60, but using the second threaded bore 59 instead of bore 58. As discussed in more detail below, the U-shaped channel section 48 of each vertical post 16, 18 must remain unobstructed in the area above base member 14 to receive and support merchandise mounting structure. If the bolt 60 was inserted through bore 58 at the juncture of two posts 16 and 62, it would extend into the U-shaped channel section 48. Consequently, the threaded bore 59 is provided at the forwardly facing side of the channel member 54 which forms part of extension 52, e.g., 90° from the U-shaped channel section 48 of posts 16, 18. As depicted in FIGS. 3 and 3A, the threaded bore 59 is located along channel member 54 so that when the extension 52 of the vertical post 62 is inserted within the top portion of vertical post 16, the threaded bore 59 aligns with one of the slots 50 in vertical post 16. This permits tightening of bolt 60 from the front side of posts 16, 62 through slot 50 into the threaded bore 59 causing the two channel members 54, 56 of extension 52 to spread apart as illustrated in FIG. 3A. The channel members 54, 56 engage the walls of vertical post 16 to form a secure connection with vertical post 62. The interconnected vertical posts 16, 18 and 62, 64 are stable, and allow the overall gondola unit 10 to assume different heights, as desired.

In order to provide additional flexibility in mounting merchandise to the gondola unit 10, a number of wire grids 66 are provided as best shown in FIGS. 4 and 5. Each wire grid 66 is sized to be slidably and releasably mounted between the opposed vertical posts 16, 18 when they are mounted to the base member 14. In the assembled position, the U-shaped channel section 48 of vertical posts 16 and 18 face one another so that the wire grid 66 can be retained therebetween. In one presently preferred embodiment, a total of two wire grids 66 are received and retained between the vertical posts 16, 18, with a sheet 68 of masonite or other sheet material held therebetween. The purpose of the sheet 68 is to visually separate the two wire grids 66 from one another, and, hence, the two sides of the gondola unit 10, so that one cannot look through the gondola unit 10. Additionally, the sheet 68 may be provided with art work or other indicia thereon to enhance the overall appearance of the gondola unit 10. As shown in FIG. 5, the unit 10 will include a bottom end cap 70 positioned along the base member 14 to receive the bottom of wire grid 66 and sheet 68, and, a top end cap 72 mountable along the top of wire grids 66 and sheet 68 to provide the unit 10 with a finished appearance. The top end cap 72 has a downwardly extending arm 74 at each end which are insertable within the tubular shaped portion 46 of each vertical post 16, 18 at the top end thereof. As such, the top end cap 72 also adds stability to the unit 10 by securing the top ends of vertical posts 16, 18 together. In the event the gondola unit 10 includes vertical posts 62 and 64, as depicted in FIG. 5, a center cap 76 is positioned between a first set of wire grids 66 and sheet 68 located between the vertical posts 16, 18, and a second set of wire grids 66 and sheet 68 mounted between the vertical posts 62 and 64. With the wire grids 66 in position, hooks, brackets or other mounting devices (not shown) are supported by the wire grids 66 for the display of merchandise thereon.

As noted above, each gondola unit 10 is movable along the surface upon which it is mounted by the swivel rollers 32, and such movement can take place either with or without merchandise mounted to the wire grids 66 of the unit 10. Levelers (not shown) are mounted to the cross braces 28, 30 for positioning the gondola unit 10 in a leveled, horizontal position within a retail establishment for display purposes. The levelers are retracted, allowing the swivel rollers 32 to contact the floor surface, when it is desired to move the gondola unit 10 to another location.

H-Frame Unit

Referring now to FIG. 6, the H-frame unit 12 is illustrated in detail. As noted above, one advantage of the fixture of this invention is the interchangeability of a number of the structural elements from the gondola unit 10 to the H-frame unit 12. For purposes of the present discussion, the same reference numbers used in connection with a description of the elements of gondola unit 10 are applied to the same structure in the H-frame unit 12.

As depicted in FIG. 6, the H-frame unit 12 includes two base members 14 and 14' mounted end-to-end and interconnected where they abut one another by connector brackets 40 in the identical manner described above in connection with the gondola unit 10 shown in FIGS. 1–5. Using two base members 14, 14', a total of four vertical posts are employed. A vertical post 16 is mounted to base member 14 at its corner sleeve 34A, and a vertical post 18 is mounted to base member 14 at corner sleeve 34D using the same locking arrangement depicted in FIGS. 2 and 3 and described in detail above. Similarly, a corner post 16' is mounted to the corner sleeve 34B' of base member 14', and vertical post 18' is mounted at corner sleeve 34C' of base member 14'. A horizontal beam 78 extends between the corner posts 16 and 16', and a second horizontal beam 80 extends between connector posts 18, 18'. Each horizontal beam 78, 80 has a mounting plate at 82 at opposite ends formed with tabs 84 which are insertable within the slots 50 formed in the tubular shaped portion 46 of each vertical post 16, 16' and 18, 18'. The horizontal beams 78, 80 mount a shelf 86, formed of a wire grid material as depicted in FIG. 6, or other type of shelving material.

While only one set of horizontal beams 78, 80 and one shelf 86 are depicted in FIG. 6, it should be understood that multiple shelves 86 could be provided along the height of H-frame unit 12 as desired. In that respect, it is noted that vertical posts 62, 62' and 64, 64' could be added to the unit 12 in the same fashion as in the gondola unit 10, as described in detail above, to increase the overall height of H-frame unit 12 in order to accommodate additional shelves 86 and/or to support merchandise of variable height. A top end cap 72 with arms 74, as described above in connection with FIG. 5, is also employed in the H-frame unit 12 to provide a finished appearance and add structured stability. The top end cap 72 is insertable within corner posts 16, 18 and 16', 18' or within the vertical posts 62, 64 an 62', 64'.

As depicted on the right-hand side of FIG. 6, it may be desirable in some applications to incorporate a wire grid 66 at one or both ends of the H-frame unit 12 to provide additional merchandise display space. In order to retain a wire grid 66 in place between vertical posts 16', 18', for example, a grid support channel 88 is mounted at either end by a pair of hook plates 90 and 91 in a position substantially flush with the outwardly facing surface of corner posts 16', 18'. Each hook plate 90, 91 has hooks insertable within the inside slots 50 of corner posts 16', 18'. The grid support channel 88 is formed with grooves or channels 95, 97 at its top and bottom, as shown in FIG. 6, to receive and retain one edge of a wire grid 66. The bottom groove 97 faces a bracket 99, mounted to base unit 14', which is formed with an upturned edge 101. The wire grid 66 rests atop the bracket 99 and is prevented from moving outwardly by the edge 101. In order to improve the aesthetics and safety of the overall H-frame unit 12, finish caps 92 are mounted to the inside surface of each vertical post 16, 16' and 18, 18'. One finish cap 92 is depicted on the left-hand side of FIG. 6 for purposes of illustration.

The H-frame unit 12 is movable along the floor of a retail establishment in the same manner as gondola unit 10 described above without requiring the removal of any of the shelves 86 or the merchandise resting thereon. Although only two base members 14 and 14' are shown in FIG. 6, forming one H-frame unit 12, it should be understood that essentially any number of base member pairs can be oriented end-to-end to form a number of H-frame units 12 in a row or aisle within a particular retail establishment.

Combination Unit

With reference to FIG. 7, the combination unit 100 of this invention is illustrated. The unit 100 includes essentially the same structural elements as the gondola unit 10 and the H-frame unit 12, and the same reference numbers are therefore used in FIG. 7 to depict elements shown in FIGS. 1–6 and described above.

The basic construction of combination unit 100 shown in FIG. 7 is only one example of how features of the gondola unit 10 and H-frame unit 12 can be combined with one another. The unit 100 has the basic configuration of the H-frame unit 12 depicted in FIG. 6, including two base members 14, 14' with vertical posts 16, 16' and 18, 18' at the corners interconnected by horizontal beams 78 and 80, respectively. Unlike the H-frame unit 12, the combination unit 100 includes a total of four sets of vertical posts extending along the center of base members 14, 14'. One set of vertical posts 16, 62 is mounted to the center sleeve 36A of base member 14, a second set of posts 18, 64 is mounted to the center sleeve 36B of base member 14, a third set of vertical posts 16', 62' is mounted to the center sleeve 36A' of base member 14', and, a fourth set of vertical posts 18', 64' is mounted to the center sleeve 36B' of base member 14'. Although not shown in FIG. 7, these sets of vertical posts could be mounted in the internal sleeves 37A, 37B of base member 14 and internal sleeves 37A', 37B' of base member 14', if desired.

One advantage of the combination unit 100 compared to units 10 and 12 is increased flexibility in displaying merchandise. With the vertical posts at the center of base members 14, 14', a comparatively narrow shelf 102 can be mounted between one or both of the horizontal beams 78, 80 and the vertical posts 16, 18 and 62, 64 or, alternatively, such shelf 102 can be cantilevered from the vertical posts 16, 18 and 62, 64 without being supported on the horizontal beams 78, 80. For some merchandise, this is preferable to the relatively wide shelf 86 in the H-frame unit 12 which extends continuously between the beams 78, 80. Additionally, wire grids 66 are insertable between facing vertical posts 16, 18 and 16', 18', as well as between the upper vertical posts 62, 64 and 62', 64', in the same manner as described above in connection with a discussion of FIG. 5, to provide a vertically extending support for displaying merchandise in addition to the horizontal shelf 102. Wire grids 66 can also be mounted at the ends of combination unit 100, in the same manner depicted in the H-frame unit 12 of FIG. 6, if additional display space is required. Further, by positioning the vertical posts 16, 18 in different internal sleeves 37A, 37B along the base members 14, 14', i.e., given that the internal sleeves 37A, 37B can be located anywhere between the corners of the base members 14, 14' as discussed above, horizontal shelves 102 of different depths can be employed in the combination display 100 to accommodate merchandise of essentially any size. Therefore, the combination display 100 of this invention provides both horizontal and vertical merchandise display structure in a single unit, and can be readily adapted to support horizontal shelves 102 of different depth by merely selecting a different internal sleeve 37A, B within which the vertical posts 16, 18 are mounted.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, the H-frame unit 12 shown in FIG. 6 includes two base members 14, 14' oriented end-to-end with the corner posts 16, 18 being connected to base member 14 and the corner posts 16', 18' being connected to base member 14'. If desired, a single base member 14 can be employed to form a smaller H-frame unit, with posts 16 and 18 inserted within each of the corner sleeves 34A–D and shorter horizontal beams connected between the posts within corner sleeves 34A, B and between corner sleeves 34C, D.

Additionally, whereas wire grids 66 are illustrated in the Figs. as extending between the vertical posts 16, 18 of the gondola unit 10 and combination unit 100, it should be understood that one or more masonite sheets or pegboard could be employed, if desired.

Therefore, it is intended that the invention not be limited to the particular embodiment disclosed as the best mode contemplated for carrying out this invention, but the invention will include all embodiments falling within the scope of the appended claims.

Wherefore, I claim:

1. A fixture for displaying merchandise, comprising:

a base member having opposed end walls and opposed side walls which are interconnected to form four corners and an interior;

a first post support mounted adjacent to each of said corners of said base member, and at least one second post support mounted to each of said end walls of said base member at a location in between said corners;

a number of vertical posts each capable of being releasably mounted to said first post supports and to said second post supports;

a merchandise panel removably carried between a pair of said vertical posts each mounted to one of said second post supports.

2. The apparatus of claim 1 in which said base member further includes a first cross brace mounted between said opposed side walls and extending substantially parallel and adjacent to one of said end walls, and a second cross brace mounted between said opposed side walls and extending substantially parallel and adjacent to the other of said end walls, said first and second cross braces each having opposed ends which mount a roller.

3. The apparatus of claim 1 in which each of said first and second post supports is a sleeve within which a section of said vertical posts is received and releasably secured.

4. The apparatus of claim 1 in which each of said vertical posts has a top end and a bottom end, said bottom end of one vertical post being releasably securable within said top end of another vertical post to permit variation of the overall height thereof.

5. The apparatus of claim 1 in which said merchandise support panel is a wire grid.

6. The apparatus of claim 5 in which each of said vertical posts has a cross section including a tubular-shaped portion and a U-shaped channel section, said pair of vertical posts being mounted within said second post supports so that said U-shaped channel portion of one vertical post faces said U-shaped channel portion of the other vertical post, said wire grid being removably insertable between said pair of vertical posts and held in place by said U-shaped channel sections.

7. The apparatus of claim 6 in which two wire grids are inserted between said pair of vertical posts, and a display sheet is inserted between said two wire grids.

8. A fixture for displaying merchandise, comprising:

at least one base member having opposed end walls and opposed side walls which are interconnected to form four corners and an interior;

a first post support mounted adjacent to each of said corners of said at least one base member, and at least one second post support mounted to each of said end walls of said at least one base member at a location in between said corners;

a number of vertical posts each capable of being releasably mounted to said first post supports and to said second post supports;

at least one first beam connected between a first pair of said vertical posts each mounted to one of said first post supports adjacent opposed corners of said at least one base member, and at least one second beam connected between a second pair of said vertical posts each mounted to one of said first post supports adjacent opposed corners of said at least one base member, said first beam and said second beam being spaced from one another and extending substantially parallel to said side walls of said at least one base member;

a shelf unit supported on said first and second beams.

9. The fixture of claim 8 in which said at least one base member comprises a first base member and a second base member mounted end-to-end.

10. The fixture of claim 9 in which said first pair of vertical posts are mounted one in a first post support of said first base member and the other in a first post support of said second base member, said second pair of vertical posts being mounted one in a first post support of said first base member and the other in a first post support of said second base member.

11. The apparatus of claim 8 in which said at least one base member further includes a first cross brace mounted between said side walls and extending substantially parallel and adjacent to one of said end walls, and a second cross brace mounted between said side walls and extending substantially parallel and adjacent to the other of said end walls, said first and second cross braces each having opposed ends which mount a roller.

12. The apparatus of claim 8 in which each of said first and second post supports is a sleeve within which a section of said vertical posts is received and releasably secured.

13. The apparatus of claim 8 in which each of said vertical posts has a top end and a bottom end, said bottom end of one vertical post being releasably securable within said top end of another vertical post to permit variation of the overall height thereof.

14. The apparatus of claim 8 in which each of said vertical posts releasably mounts a U-shaped channel member, said channel members being mounted to said vertical posts so that they face one another.

15. The apparatus of claim 14 in which a merchandise support panel is removably mounted between opposed channel members along at least one of said end walls.

16. The apparatus of claim 15 in which said merchandise support panel is a wire grid.

17. A fixture for displaying merchandise, comprising:

a number of base members each having opposed end walls and opposed side walls which are interconnected to form four corners and an interior;

a first post support mounted adjacent to each of said corners of each base member, and at least one second post support mounted to each of said end walls of each base member at a location between said corners, said base members being positionable so that said end wall of one base member abuts said end wall of an adjacent base member and said first post supports at two corners of one base member are located adjacent said first post supports of the abutting base member;

at least two connector members, each of said connector members spanning said end walls of adjacent base members and being releasably mountable within said first post support of one base member and within said first post support of the adjacent base member;

a number of vertical posts each capable of being releasably mounted to said first post supports and to said second post supports;

a merchandise display panel removably carried between a pair of said vertical posts each mounted to one of said second post supports.

18. The apparatus of claim 17 in which said merchandise display panel is a wire grid.

19. The apparatus of claim 18 in which each of said vertical posts has a cross section including a tubular-shaped portion and a U-shaped channel section, said pair of vertical posts being mounted within said second post supports so that said U-shaped channel section of one vertical post faces said U-shaped channel section of the other vertical post, said wire grid being removably insertable between said pair of vertical posts and held in place by said U-shaped channel sections.

20. The apparatus of claim 19 in which two wire grids are inserted between said pair of vertical posts, and a display sheet is inserted between said two wire grids.

21. A fixture for displaying merchandise, comprising:

a number of base members each having opposed end walls and opposed side walls which are interconnected to form four corners and an interior;

a first post support mounted adjacent to each of said corners of each base member, and at least one second post support mounted to each of said end walls of each base member at a location between said corners, said base members being positionable so that said end wall of one base member abuts said end wall of an adjacent base member and said first post supports at two corners of one base member are located adjacent said first post supports of the abutting base member;

at least two connector members, each of said connector members spanning said end walls of adjacent base members and being releasably mountable within said first post support of one base member and within said first post support of the adjacent base member;

a number of vertical posts each capable of being releasably mounted to said first post supports and to said second post supports, one pair of said vertical posts being mounted to said first post supports of one base member opposite said connector members, and a second pair of said vertical posts being mounted to said first post supports of the abutting base member opposite said connector members;

at least one first beam connected between said vertical post of said one base member and said vertical post of the abutting base member, and at least one second beam connected between the other vertical post of said one base member and the other vertical post of said abutting base member;

a shelf unit supported on said first and second beams.

22. The apparatus of claim 21 in which each of said vertical posts releasably mounts U-shaped channel member, said U-shaped channel members being mounted to said vertical posts so that they face one another.

23. The apparatus of claim 22 in which a merchandise display panel is removably mounted between opposed U-shaped channel members along at least one of said end walls.

24. The apparatus of claim 23 in which said merchandise support panel is a wire grid.

25. A fixture for displaying merchandise, comprising:

at least one base member having opposed end walls and opposed side walls which are interconnected to form four corners and an interior;

a first post support mounted adjacent to each of said corners of said at least one base member, and at least one second post support mounted to each of said end walls of said at least one base member at a location in between said corners;

a number of vertical posts each capable of being releasably mounted to said first post supports and to said second post supports;

at least one first beam connected between a first pair of said vertical posts each mounted to one of said first post supports adjacent opposed corners of said at least one base member, and at least one second beam connected between a second pair of said vertical posts each mounted to one of said first post supports adjacent opposed corners of said at least one base member, said first beam and said second beam being spaced from one another and extending substantially parallel to said side walls of said at least one base member;

a third set of vertical posts each mounted to one of said second post supports;

at least one shelf unit extending from said third set of vertical posts;

at least one merchandise panel removably carried between said third set of vertical posts.

26. The fixture of claim 25 in which said at least one base member comprises a first base member and a second base member mounted end-to-end.

27. The fixture of claim 26 in which said first pair of vertical posts are mounted one in a first post support of said first base member and the other in a first post support of said second base member, said second pair of vertical posts being mounted one in a first post support of said first base member and the other in a first post support of said second base member;

said third set of vertical supports including a first vertical post mounted to said second post support at one end wall of said first base member, a second vertical post mounted to said second post support at the opposite end wall of said first base member in abutment with said second base member, a third vertical post mounted to said second post support of said second base member at the end wall thereof in abutment with said first base member, and, a fourth vertical post mounted to said second post support at the opposite end wall of said second base member.

28. The apparatus of claim 25 in which said at least one base member further includes a first cross brace mounted between said side walls and extending substantially parallel and adjacent to one of said end walls, and a second cross brace mounted between said side walls and extending substantially parallel and adjacent to the other of said end walls, said first and second cross braces each having opposed ends which mount a roller.

29. The apparatus of claim 25 in which each of said first and second post supports is a sleeve within which a section of said vertical posts is received and releasably secured.

30. The apparatus of claim 25 in which each of said vertical posts has a top end and a bottom end, said bottom end of one vertical post being releasably securable within said top end of another vertical post to permit variation of the overall height thereof.

31. The apparatus of claim 25 in which each of said third set of vertical posts has a cross section including a tubular-shaped portion and a U-shaped channel section, said set of vertical posts being mounted within said second post support so that said U-shaped channel section of one vertical post faces said U-shaped channel section of another vertical post to receive said merchandise panel therebetween.

* * * * *